US011697564B2

(12) United States Patent
Kashiba et al.

(10) Patent No.: US 11,697,564 B2
(45) Date of Patent: Jul. 11, 2023

(54) SHEET DETECTION DEVICE AND SHEET DETECTION METHOD

(71) Applicant: Horizon International Inc., Takashima (JP)

(72) Inventors: Masayuki Kashiba, Takashima (JP); Tomoyuki Shimizu, Takashima (JP)

(73) Assignee: Horizon International, Inc., Takashima (JP)

( * ) Notice: Subject to any disclaimer, the term of this patent is extended or adjusted under 35 U.S.C. 154(b) by 0 days.

(21) Appl. No.: 17/075,373

(22) Filed: Oct. 20, 2020

(65) Prior Publication Data

US 2021/0114831 A1 Apr. 22, 2021

(30) Foreign Application Priority Data

Oct. 21, 2019 (JP) ..... 2019-191749

(51) Int. Cl.

| | |
|---|---|
| ***B65H 7/14*** | (2006.01) |
| ***B65H 37/06*** | (2006.01) |
| ***B65H 5/06*** | (2006.01) |
| ***B65H 37/04*** | (2006.01) |
| ***B65H 29/66*** | (2006.01) |
| ***B65H 45/22*** | (2006.01) |

(52) U.S. Cl.

CPC ..... *B65H 7/14* (2013.01); *B65H 5/062* (2013.01); *B65H 29/66* (2013.01); *B65H 37/04* (2013.01); *B65H 37/06* (2013.01); *B65H 45/22* (2013.01)

(58) Field of Classification Search

CPC ..... G06M 7/10; G06M 2207/02

See application file for complete search history.

(56) References Cited

U.S. PATENT DOCUMENTS 3,239,676 A * 3/1966 Pali ..... G06M 7/10 250/223 R
3,834,289 A * 9/1974 Behrens ..... G06M 7/10 271/265.04

(Continued)

FOREIGN PATENT DOCUMENTS

CN 1931600 A 3/2007
EP 0202507 A2 11/1986

(Continued)

OTHER PUBLICATIONS

Extended European Search Report dated Apr. 23, 2021 in corresponding application 20200763.9.

*Primary Examiner* — Jennifer Bahls

(74) *Attorney, Agent, or Firm* — Muncy, Geissler, Olds & Lowe, P.C.

(57) ABSTRACT

Each of the sheets is conveyed by a horizontal conveyance unit in a state of being overlapped with a next sheet from above. Each of the sheets is conveyed out of the horizontal conveyance unit in a state of being folded along a fold line with the fold line oriented upward, the fold line extending in a conveyance direction of the horizontal conveyance unit. An oblique conveyance unit receives the sheet from the horizontal conveyance unit and successively conveys the sheets in an oblique downward direction. A sensor is arranged to detect passage of the sheets at a position where steps pass. Each of the steps is formed by two sheets adjacent to each other diverted to the oblique downward direction by the oblique conveyance unit.

9 Claims, 6 Drawing Sheets

(56) References Cited

U.S. PATENT DOCUMENTS

| | | | | |
|---|---|---|---|---|
| 4,127,262 | A | 11/1978 | Eberle et al. | |
| 4,133,523 | A | 1/1979 | Berthelot | |
| 4,641,825 | A | 2/1987 | Mowry et al. | |
| 5,044,873 | A | 9/1991 | Vijuk | |
| 5,729,816 | A | 3/1998 | Matsumoto et al. | |
| 7,261,507 | B2 | 8/2007 | Horii et al. | |
| 7,534,201 | B2 | 5/2009 | Yamamoto et al. | |
| 2002/0042333 | A1 | 4/2002 | Boss | |
| 2004/0161072 | A1* | 8/2004 | Sjogren | B65H 43/00 377/7 |
| 2007/0063407 | A1 | 3/2007 | Langenegger et al. | |
| 2007/0272361 | A1 | 11/2007 | Cracknell et al. | |
| 2019/0351692 | A1* | 11/2019 | Ida | B42C 19/08 |

FOREIGN PATENT DOCUMENTS

| | | | | |
|---|---|---|---|---|
| EP | 1331105 | A2 * | 7/2003 | B42B 4/00 |
| EP | 1331105 | A2 | 7/2003 | |
| EP | 1840062 | A1 | 10/2007 | |
| EP | 2674376 | A2 * | 12/2013 | B65H 5/26 |
| JP | 2002-200865 | A | 7/2002 | |
| JP | 2003-326495 | A | 11/2003 | |
| JP | 2016188116 | A | 11/2016 | |

* cited by examiner

SHEET DETECTION DEVICE AND SHEET DETECTION METHOD

This application claims the benefit of foreign priority to Japanese patent application serial No. 2019-191749, filed on Oct. 21, 2019, which is incorporated by reference herein in its entirety.

BACKGROUND OF THE INVENTION

Field of the Invention

The present disclosure relates to a device and a method for detecting sheets, and more particularly, to detection of sheets which are being successively conveyed.

Description of the Background Art

A saddle stitch binding system is well known, for example, as disclosed in Japanese Unexamined Patent Application Publication No. 2003-326495 and Japanese Unexamined Patent Application Publication No. 2002-200865. The saddle stitch binding system typically folds printed sheets, stacks a number of the folded sheets corresponding to a booklet to form a sheet stack, and then stitches the sheet stack.

The binding system disclosed in Japanese Unexamined Patent Application Publication No. 2002-200865 includes the conveyance device that successively and horizontally conveys sheets with the sheets overlapped with one another. In the conveyance device, each of the sheets is overlapped with the next sheet from above. The sheets are conveyed in this state by the conveyance device.

The binding system receives the sheets from the conveyance device, folds the sheets in halves and stacks a number of the folded sheets corresponding to a booklet in a straddling manner to form a sheet stack. In order to exactly sort the sheets into the sheet stacks, detection of the sheets is required before stacking.

More specifically, the sheets are first conveyed by a conveyance device to an accumulation device and accumulated in the accumulation device, so that a pile of sheets is formed. A lowermost sheet of the pile of sheets is pulled out and folded by grip means one after another. Then, a number of the folded sheets corresponding to a booklet are stacked on a knife to form a sheet stack. As the sheet is pulled out, a control code or barcode on the sheet is detected by a read head. The detection by the read head allows for exact sorting of the sheets.

For the purpose of exact sorting of the sheets, it may be conceived to detect the sheets at the position where the conveyance device successively conveys the sheets. However, there is no gap between the sheets since the sheets are conveyed in an overlapped state. Therefore, passage of the sheets fails to be detected during the successive conveyance using simple means (such as a photoelectronic sensor) for detecting the presence or absence of a sheet.

SUMMARY OF THE INVENTION

An object of the present disclosure is to provide a device and a method which facilitate detection of passage of sheets which are being successively conveyed.

According to an aspect of the present disclosure, there is provided a sheet detection device. The sheet detection device includes a horizontal conveyance unit configured to convey sheets successively and horizontally. Each of the sheets is conveyed out of the horizontal conveyance unit in a state of being folded along a fold line with the fold line oriented upward, the fold line extending in a conveyance direction of the horizontal conveyance unit.

The sheet detection device further includes an oblique conveyance unit including a pair of conveyance members arranged for receiving the sheets from the horizontal conveyance unit. The oblique conveyance unit is configured to successively convey the sheets in an oblique downward direction through the pair of conveyance members while sandwiching both sides of the sheets between the pair of conveyance members.

The sheet detection device further includes a sensor arranged to detect passage of the sheets at a position where steps pass, each of the steps being formed by two sheets adjacent to each other diverted to the oblique downward direction by the oblique conveyance unit.

Each of the sheets may be conveyed by the horizontal conveyance unit in a state of being overlapped with a next sheet from above.

The pair of conveyance members may be a pair of conveyance rollers or a pair of conveyance belts.

The horizontal conveyance unit may be further configured to fold the sheets while conveying the sheets.

The sensor may be arranged to detect passage of the sheets at the position where the steps pass, each of the steps being formed by a upper edge of a sheet of the two sheets and a front edge of a next sheet of the two sheets. The sensor may be arranged to detect passage of the sheets at the position where the steps pass, each of the steps being formed by a rear edge of a sheet of the two sheets and a lower edge of a next sheet of the two sheets.

The sensor may be an optical sensor.

According to another aspect of the present disclosure, there is provided a method for detecting sheets which are being successively conveyed. Each of the sheets is conveyed out of the horizontal conveyance unit in a state of being folded along a fold line with the fold line oriented upward, the fold line extending in a conveyance direction of the horizontal conveyance unit.

The method includes: successively conveying the sheets which have been conveyed out of the horizontal conveyance unit, in an oblique downward direction using a pair of conveyance rollers through the pair of conveyance rollers while sandwiching both sides of the sheets between the pair of conveyance rollers.

The method further includes: detecting passage of the sheets using a sensor at a position where steps pass, each of the steps being formed by two sheets adjacent to each other which have been diverted to the oblique downward direction.

Each of the sheets may be conveyed by the horizontal conveyance unit in a state of being overlapped with a next sheet from above.

A pair of conveyance rollers or a pair of conveyance belts may be used as the pair of conveyance members.

Each of the steps may be formed by an upper edge of a sheet of the two sheets and a front edge of a next sheet of the two sheets. Each of the steps may be formed by a rear edge of a sheet of the two sheets and a lower edge of a next sheet of the two sheets.

An optical sensor is used as the sensor.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
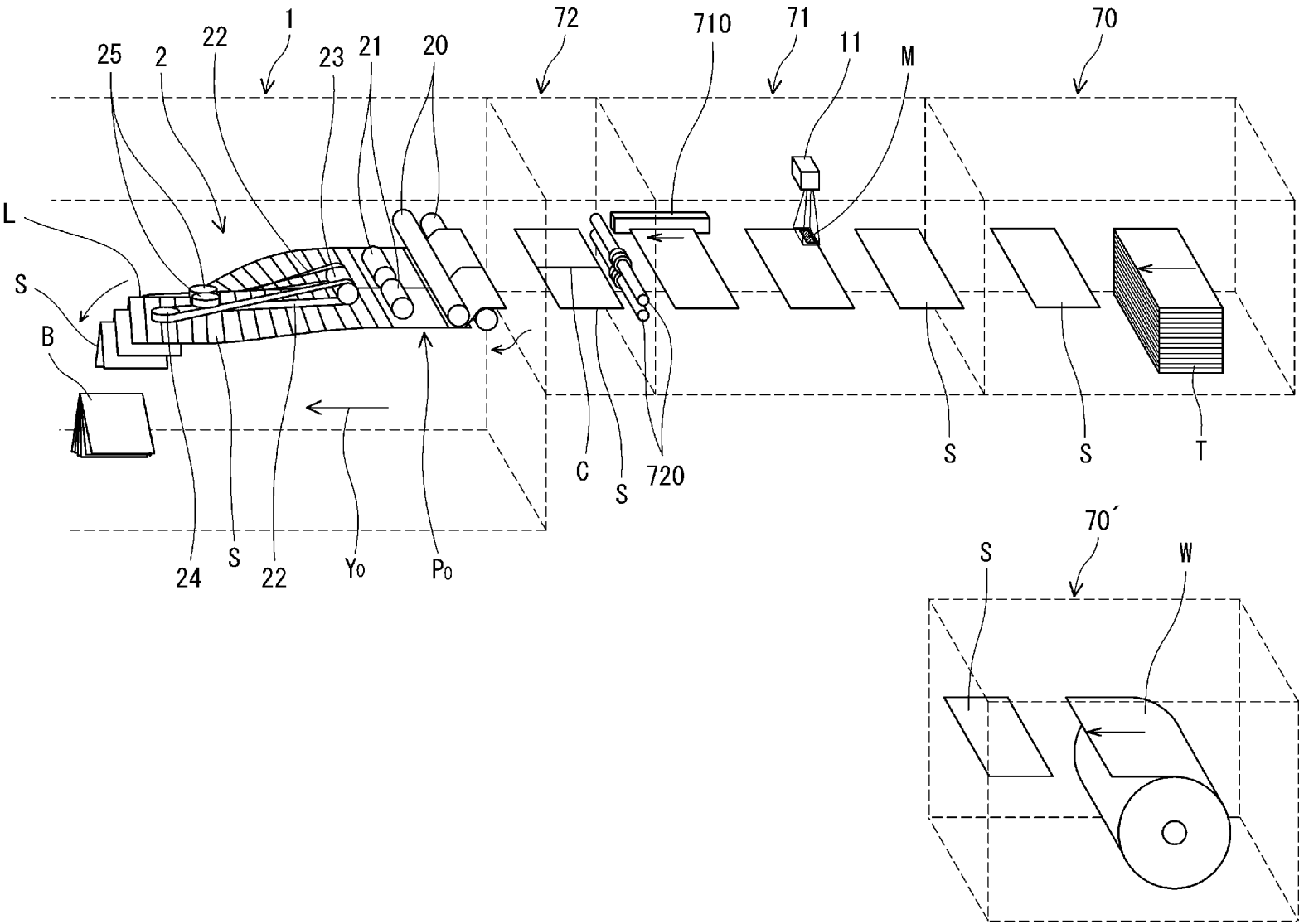
FIG. 1 is a partial and schematic view of an exemplary binding system.

Exemplary embodiments will be described, wherein like reference numerals designate corresponding or identical elements throughout the various drawings.

FIG. 1 is a schematic view of an upstream section of a binding system including a detection sheet device according to an embodiment of the present disclosure. More specifically, the binding system is a saddle stitch binding system. The binding system includes a stacking device 1 configured to stack a predetermined number of sheets S (in this embodiment, a number of the sheets S corresponding to a booklet) to form a sheet stack B. The number of the sheets S that form a sheet stack B may be same for each sheet stack B, and may be different for each sheet stack B. As described below, the sheet detection device is provided in the stacking device 1.

The binding system includes a sheet feeder 70 configured to feed sheets S, a conveyance device 71 configured to convey the sheets S, and a creasing device 72 configured to crease the sheets S.

The sheet feeder 70 feeds the sheets S one by one from a large stack T to the conveyance device 71. For digital printing, the sheet feeder 70 may include a printer (not shown) configured to print the sheets S in order to feed the printed sheets S. Alternatively, the sheet feeder 70 may feed the sheets S that have been printed in advance. Instead of the sheet feeder 70, a sheet feeder 70' may cut a web W using a cut device to make sheets S from the web W, and feed the sheets S. The web W or the sheets S may be printed by a printer. Alternatively, the web S that has been printed in advance may be used.

The conveyance device 71 receives the sheets S from the sheet feeder 70 and conveys the sheets S to the creasing device 72. The conveyance device 71 includes a conveyor (not shown) having a conveyance surface extending in a conveyance direction and configured to convey the sheets S which are placed on the conveyance surface. The conveyance device 71 of the embodiment further includes a reference guide 710 extending parallel to the conveyance direction. The conveyor conveys each sheet S obliquely toward the reference guide 710 such that a side edge of the sheet S comes into contact with the reference guide 710 over its entire length during conveyance, causing the skew of the sheet S to be corrected. Each sheet S is conveyed to the creasing device 72 with the skew thereof corrected.

The creasing device 72 receives the sheets S from the conveyance device 71, creases each sheet S to form a crease C on the sheet S, and conveys the sheets S to the stacking device 1. The creasing device 72 includes a pair of creasing rollers 720. The creasing device 72 conveys each sheet S through the pair of creasing rollers 720 to form on the sheet S the crease C extending in the conveyance direction. The creasing device 72 then conveys each sheet S to the stacking device 1.

The stacking device 1 includes the horizontal conveyance unit 2 configured to receive the sheets S from the creasing device 72 and to successively convey the sheets S with the sheets S overlapped (that is, partly covered) with one another. A reference $Y_0$ in FIG. 1 designates a horizontal conveyance direction of the horizontal conveyance unit 2. In a horizontal unit 2, each of the sheets S is overlapped with the next sheet S from above. In other words, each of the sheets S is superposed on the previous sheet S to be shifted in the direction opposite to the conveyance direction $Y_0$.

The horizontal conveyance unit 2 is further configured to fold the sheets S in the conveyance direction $Y_0$, more specifically along the creases C, while conveying the sheets S. Each of the sheets S is then conveyed out of the horizontal conveyance unit 2 in a state of being folded along a fold line L (which extends in the conveyance direction $Y_0$) with the fold line L oriented upward.

In order to achieve this, the horizontal conveyance unit 2 includes a pair of guide rollers 20 for guiding the sheets S to an overlapping position $P_0$ which is used for overlapping the sheets S, and a feed roller 21 arranged at the overlapping position $P_0$ for feeding the sheets S from the overlapping position $P_0$. Each of these rollers 20 and 21 is rotatable about an axis extending in the horizontal direction which is perpendicular to the conveyance direction $Y_0$.

Each of the sheets S is guided by the pair of guide rollers 20 from the creasing device 72 to the overlapping position $P_0$, and then fed by the feed roller 21 from the overlapping position $P_0$ in the conveyance direction $Y_0$. As the sheet S is guided to the overlap position $P_0$, rotation of the feed roller 21 is controlled to cause the sheet S to overlap on the previous sheet S from above. Repeating this enables the sheets S to be conveyed in an overlapped state.

The horizontal conveyance unit 2 further includes two conveyance belts 22, an upstream pulley 23, and two downstream pulleys 24 (one of which is not shown). The upstream pulley 23 is rotatable about an axis extending in the horizontal direction which is perpendicular to the conveyance direction $Y_0$. The two downstream pulleys 24 are spaced from each other in the horizontal direction which is perpendicular to the conveyance direction $Y_0$. Each of the pulleys 24 is rotatable about an axis extending vertically. One of the conveyance belts 22 is engaged with the upstream pulley 23 and one of the downstream pulleys 24 to extend between these 23 and 24. The other conveyance belt 22 is engaged with the upstream pulley 23 and the other downstream pulley (not shown) to extend between these.

The horizontal conveyance unit 2 further includes a pair of fold rollers 25 located between the two conveyance belts 22. The fold rollers 25 are opposed to each other. Each of the fold rollers 25 is rotatable about an axis extending vertically.

The sheet S that has been fed by the feed roller 21 is engaged with the two conveyance belts 22 which are being driven to rotate, so that the sheet S is conveyed by the conveyance belts 22. During this conveyance, the twists of the extending parts of the conveyance belts 22 which are being engaged with the sheet S, properly guide both side sections of the sheet S downwardly to bent the sheet S such that a top is formed on the center of the sheet S. The top of the sheet S is guide to and through the pair of fold rollers 25, so that the sheet S is folded along a fold line L (along the crease C) extending in the conveyance direction $Y_0$. In this way, each of the sheets S is fold in half into a signature during the conveyance.

Each of the sheets S is conveyed out of the horizontal conveyance unit 2 in a state of being folded along the fold line L with the fold line L oriented upward. Thereafter, each of the sheets S is conveyed in the form of the signature.

Although not shown, it will be appreciated by those skilled in the art that the horizontal conveyance unit 2 includes at least one support for properly supporting the sheets S from below while the sheets S are conveyed, so as to allow the sheets S to be conveyed while being folded as described above.

Figure 2:
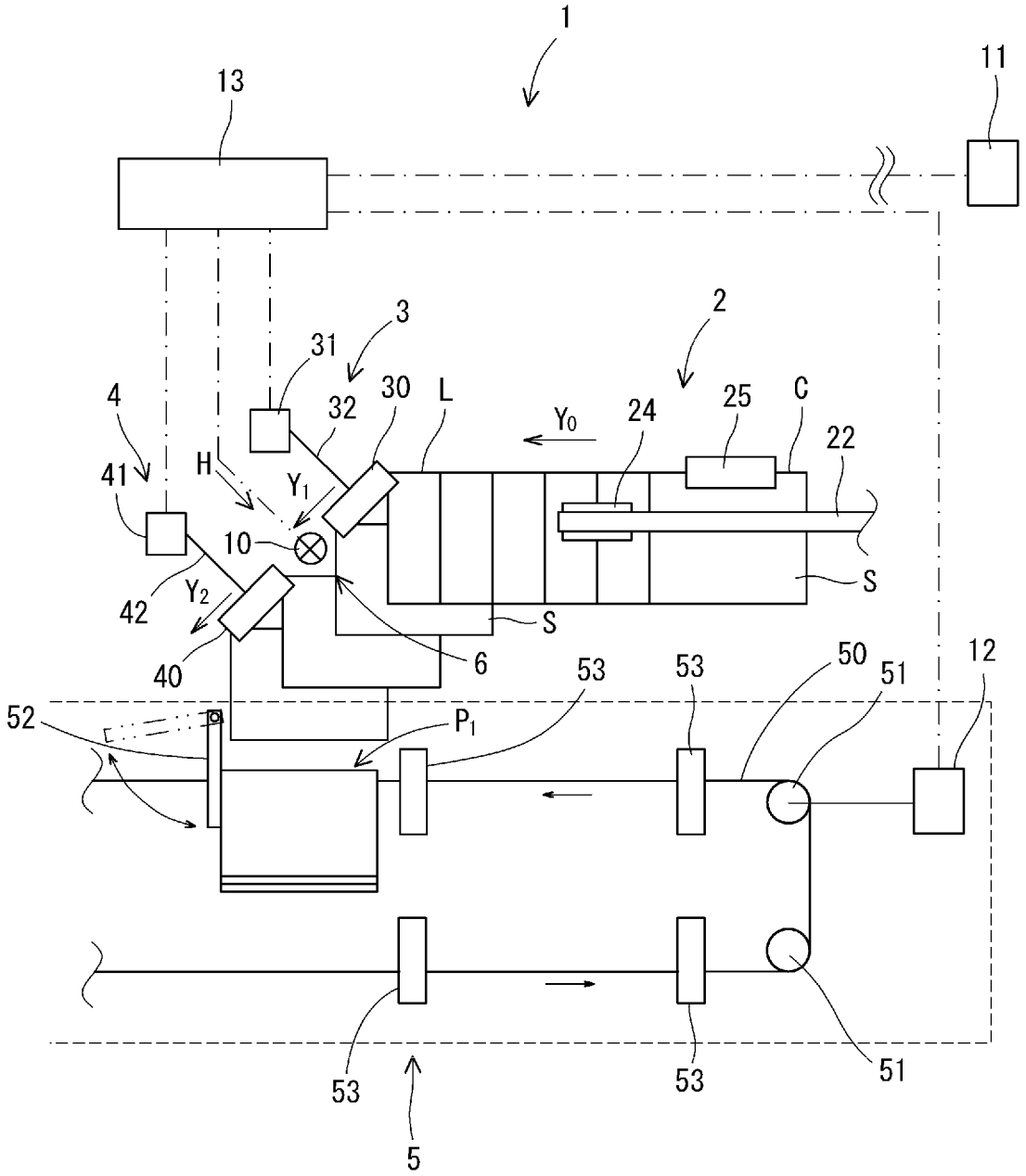
FIG. 2 is a partial and schematic view of a stacking device including an exemplary sheet detection device.

FIG. 2 illustrates an arrangement of the stacking device 1 downstream of the horizontal conveyance unit 2. The stacking device 1 includes the sheet detection device. The sheet detection device includes the horizontal conveyance unit 2 described above, an oblique conveyance unit 3 configured to receive the sheets S conveyed out of the horizontal conveyance unit 2 and to sequentially convey the sheets S in an oblique downward direction $Y_1$, and a sensor 10 for detecting the sheets S.

Figure 3:
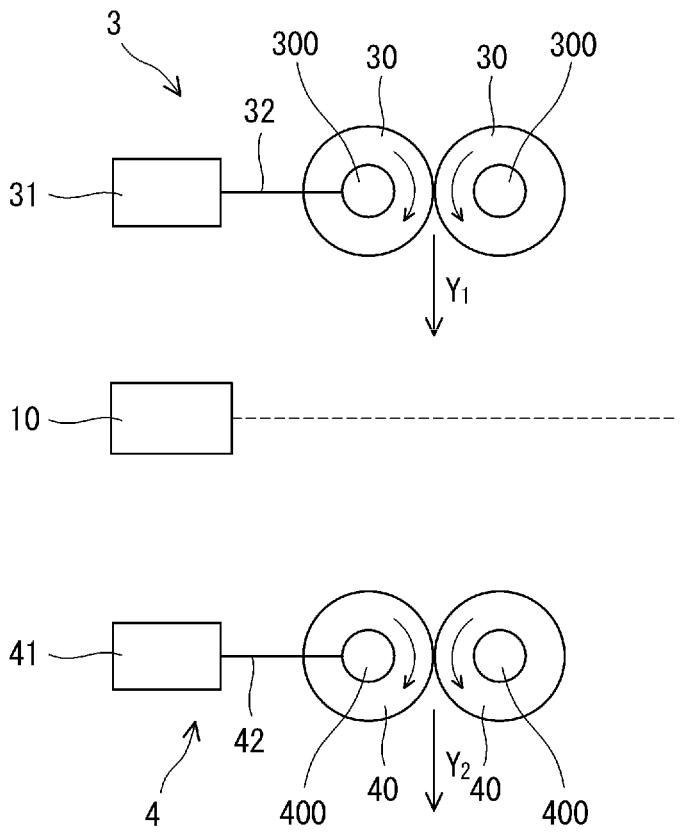
FIG. 3 is a schematic view of an exemplary sheet detection device as viewed from an arrow H in FIG. 2.

FIG. 3 is a view on arrow H in FIG. 2. The oblique conveyance unit 3 includes a pair of conveyance rollers 30 (as an example of a pair of conveyance members) arranged for receiving the sheets S (each of which is in the form of the signature) conveyed out of the horizontal conveyance unit 2, a motor 31 as a drive source for driving at least one of the conveyance rollers 30 to rotate the at least one of the conveyance rollers 30, and a transmission mechanism 32 for transmitting drive force of the motor 31 to the at least one of the conveyance rollers 30.

The pair of conveyance rollers 30 opposes each other. Each of the conveyance rollers 30 is arranged to be rotatable about an axis extending perpendicularly to the oblique downward direction $Y_1$ which is the conveyance direction of the conveyance rollers 30. More specifically, each conveyance roller 30 has a rotation shaft 300 extending perpendicularly to the conveyance direction $Y_1$ and rotatably supported by a frame (not shown). The pair of conveyance rollers 30 is positioned to be able to sandwich the front-upper section of each sheet S (see FIG. 2).

The transmission mechanism 32 is illustrated in a simplified manner since the transmission mechanism 32 has a well-known structure. For example, the transmission mechanism 32 connects the output shaft of the motor 31 to the rotation shaft(s) 300 of the conveyance roller(s) 30 to transmit the drive force of the motor 31 to the conveyance roller(s) 30. Both of the conveyance rollers 30 may be driven to rotate. Alternatively, the first conveyance roller 30 may be driven to rotate so that the second conveyance roller 30 can be dependently rotated in accordance with the rotation of the first conveyance roller 30.

The sheets S that have been conveyed out of the horizontal unit 2 are received by the pair of conveyance rollers 30 to be sandwiched from both sides thereof between the pair of conveyance rollers 30. The oblique conveyance unit 3 conveys the sheets S in the oblique downward direction $Y_1$ through the pair of conveyance rollers 30 by means of rotation of the pair the conveyance rollers 30 while sandwiching the sheets S between the pair of conveyance rollers 30. In other words, each of sheets S is diverted by the pair of conveyance rollers 30 from the horizontal direction $Y_0$ to the oblique downward direction $Y_1$.

Therefore, the sheets S that have been successively conveyed out of the horizontal conveyance unit 2 are then successively conveyed in the oblique downward direction $Y_1$ by the oblique conveyance unit 3.

Figure 4:
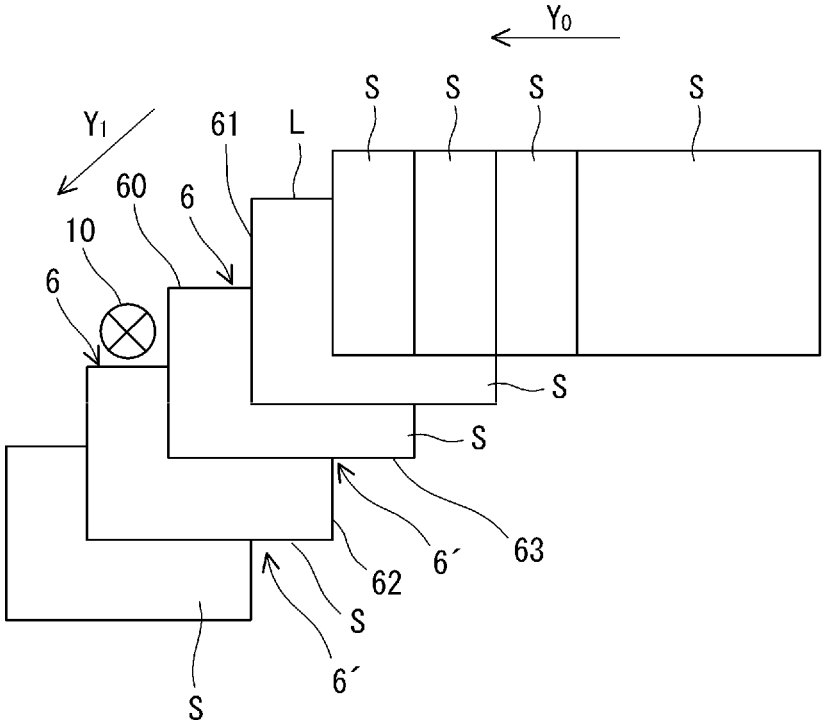
FIG. 4 illustrates an exemplary sheet detection method.

FIG. 4 illustrates an exemplary sheet detection method. As illustrated in FIG. 4, each of steps 6 is formed by two sheets S adjacent to each other that have been diverted to the oblique downward direction $Y_1$ by the pair of conveyance rollers 30 (not shown in FIG. 4) and thereby are travelling in the oblique downward direction $Y_1$. The step 6 is formed by the upper edge 60 (the fold line L) of the sheet S and the front edge 61 of the next sheet S.

No gap is formed between the sheets S while the sheets S are successively and horizontally conveyed in an overlapped state. In contrast, when the sheet S is diverted to the oblique downward direction $Y_1$ to be lowered relative to the next sheet S, the step 6 is formed by the these two sheets S adjacent to each other. The step 6 creates a gap between the sheets S.

The sensor 10 is arranged to detect passage of the sheets S (the upper edge 60 and/or the front edge 61 of each sheet S) at the position where the steps 6 pass. The sensor 10 is, for example, a sensor which detects the presence or absence of the sheet S and may be an optical sensor such as a photoelectronic sensor. The directional diversion of the sheets S and the arrangement of the sensor 10 described above allow the sensor 10 to certainly detect passage of the sheets S which are being successively conveyed, even when the sensor 10 is not a mark sensor but a simple sensor such as a sensor which detects the presence or absence of the sheet S. In this way, the sheet detection device and method facilitate the detection of passage of the sheets S which are being successively conveyed.

Another step 6' is formed by the rear edge 62 of the sheet S and the lower edge 63 of the next sheet S. In other embodiments, the sensor 10 may, therefore, be arranged to detect passage of the sheets S (the rear edge 62 and/or the lower edge 63 of each sheet S) at the position where the steps 6' pass.

An exemplary operation of the stacking device using the sheet detection device and method will be described. As illustrated in FIG. 2 and FIG. 3, the stacking device 1 further includes a downstream conveyance unit 4 configured to receive the sheets S conveyed out of the oblique conveyance unit 3 and to coveys the sheets S.

The downstream conveyance unit 4 includes a pair of conveyance rollers 40 (as an example of a pair of conveyance members) arranged for receiving the sheets S conveyed out of the oblique conveyance unit 3. The pair of conveyance rollers 40 is arranged to oppose each other. Each of the conveyance rollers 40 is arranged to be rotatable about an axis extending perpendicularly to a conveyance direction $Y_2$. More specifically, each conveyance roller 40 has a rotation shaft 400 extending perpendicularly and rotatably supported by a frame (not shown). The pair of conveyance rollers 40 is positioned to be able to sandwich the front-upper section of each sheet S (see FIG. 2).

In the embodiment, the conveyance direction $Y_2$ of the downstream conveyance unit 4 is the same oblique downward direction as the conveyance direction $Y_1$ of the oblique conveyance unit 3. The conveyance direction $Y_2$ may be different from the conveyance direction $Y_1$. Furthermore, the conveyance direction $Y_2$ is not limited to an oblique downward direction.

Like the oblique conveyance unit 3, the oblique conveyance unit 4 further includes a motor 41 as a drive source for driving at least one of the conveyance rollers 40 to rotate the at least one of the conveyance rollers 40, and a well-known transmission mechanism 42 for transmitting the drive force of the motor 41 to the at least one of the conveyance rollers 40. At least one of the conveyance rollers 40 is driven to rotate by the motor 41 and the transmission mechanism 42.

The downstream conveyance unit 4 is configured to convey the sheets S (which have been conveyed out of the oblique conveyance unit 3) through the pair of conveyance rollers 40 in the conveyance direction $Y_2$ by means of rotation of the pair of conveyance rollers 40 while sandwiching both sides of the sheets S between the pair of conveyance rollers 40.

As illustrated in FIG. 2, the stacking device 1 further includes a stacking unit 5 configured to receive the sheets S from the downstream conveyance unit 4, to stack a predetermined number of the sheets S at a stacking position $P_1$ so as to form a sheet stack B (FIG. 1), and to convey the sheet stack B from the stacking position $P_1$.

The stacking unit 5 includes an endless chain or belt 50 extending across the stacking position $P_1$ and defining a conveyance path for the sheet stacks B. The chain or belt 50 is engaged with sprockets or pulleys 51. The sheets S in the form of signatures are sequentially conveyed out of the downstream conveyance unit 4 to the stacking position $P_1$ and then stacked in a straddling manner on the chain or belt 50 at the stacking position $P_1$ to form a sheet stack B which consists of a predetermined number of the sheets S. Driving the chain or belt 50 to rotate the chain or belt 50 causes the sheet stack B to be conveyed from the stacking position $P_1$ in a straddling state along the conveyance path. After the sheet stack B is conveyed from the stacking position $P_1$, the chain or belt 50 is stopped. Then the sheets S for the next sheet stack B are stacked at the stacking position $P_1$ on the chain or belt 50.

The stacking unit 5 further includes a stopper 52. The stopper 52 is arranged to be movable between a contact position (see the one drawn with a solid line) where the stopper 52 is located in the conveyance path for the sheet stacks B in front of the stacking position $P_1$ to keep the sheets S or the sheet stack B from travelling from the stacking position $P_1$ by contacting the front ends of the sheets S or the front end of the sheet stack B, and a retraction position (see the one drawn with the two-dot chain line) where the stopper 52 is retracted from the conveyance path to allow the sheet stack B to being conveyed from the stacking position $P_1$. The stopper 52 is configured to be moved (rotated) by a well-known movement mechanism.

The stacking unit 5 further includes entrainment members 53 arranged at appropriate intervals on the chain or belt 50. The entrainment members 53 are the same as those disclosed in Japanese Unexamined Patent Application Publication No. 2002-200865. Each of the entrainment members 53 is used to push and align the rear end of the sheet stack B in order to assist the conveyance of a sheet stack B.

The stacking device 1 further includes a control part 13 configured to control the operation of each of the units 2 to 5. The control part 13 includes, for example, a controller.

The control part 13 is electrically connected to the above-described sensor 10 which detects passage of the sheets S. The control part 13 counts, based on detection by the sensor 10, the number of sheets S that pass through the detection area of the sensor 10. As illustrated in FIG. 1, the first or last sheet S of each sheet stack B has a mark M thereon for determining the number of the sheets S which form the sheet stack B. In order to count the number of the sheets S, the control part 13 is also electrically connected to an additional sensor 11 which is arranged to detect the marks M before the sheets S are stacked. The control part 13 is also electrically connected to a further additional sensor (not shown) which is arranged to detect passage of the sheets S before the sheets S are stacked. The control part 13 is capable of determining the number of the sheets S for each sheet stack B based on detection by the additional sensor 11 as well as detection by the further additional sensor. Therefore, the control part 13 is capable of determining when the last sheet S for the sheet stack B has passed through the pair of conveyance rollers 40, based on the detections by the sensor 10, the additional sensor 11 and the further additional sensor.

As illustrated in FIG. 2, a further additional sensor 12 is arranged in the stacking unit 5 and electrically connected to the control part 13. The sensor 12 is used to determine that the stacking unit 5 has become ready to receive the sheets S. In this embodiment, the chain or belt 50 is rotated to convey the sheet stack B from the stacking position $P_1$ and then stopped, which causes the stacking unit 5 to become ready to receive the sheets S for a next sheet stack S. That is, switching of the chain or belt 50 from rotation to stop indicates that the stacking device 5 becomes ready to receive the sheets S for the next sheet stack B. Therefore, the sensor 12 may be, for example, a rotary encoder connected to one of the sprockets or pulleys 51 to detect rotation of the chain or belt 50. The control part 13 is capable of determining when the stacking unit 5 has become ready to receive the sheets S for the next sheet stack B at the stacking position $P_1$, based on detection by the sensor 12.

The control part 13 is electrically connected to the oblique conveyance unit 3 (the motor 31) to control rotation of the conveyance roller(s) 30 via the motor 31 and the transmission mechanism 32. The control part 13 is electrically connected to the downstream conveyance unit 4 (the motor 41) to control rotation of the conveyance roller(s) 40 via the motor 41 and the transmission mechanism 42.

The control part 13 is electrically connected to the stacking unit 5 to control the operation of the stacking unit 5 such as the rotation of the chain or belt 50 and the movement of the stopper 52.

As described below, the control part 13 controls the rotation of the conveyance roller(s) 40 (as an example of a conveyance member(s)) based on the detections by the sensors 10, 11, and 12. In the following description, the control part 13 keeps the conveyance roller(s) 30 continuously rotating.

Figure 5A:
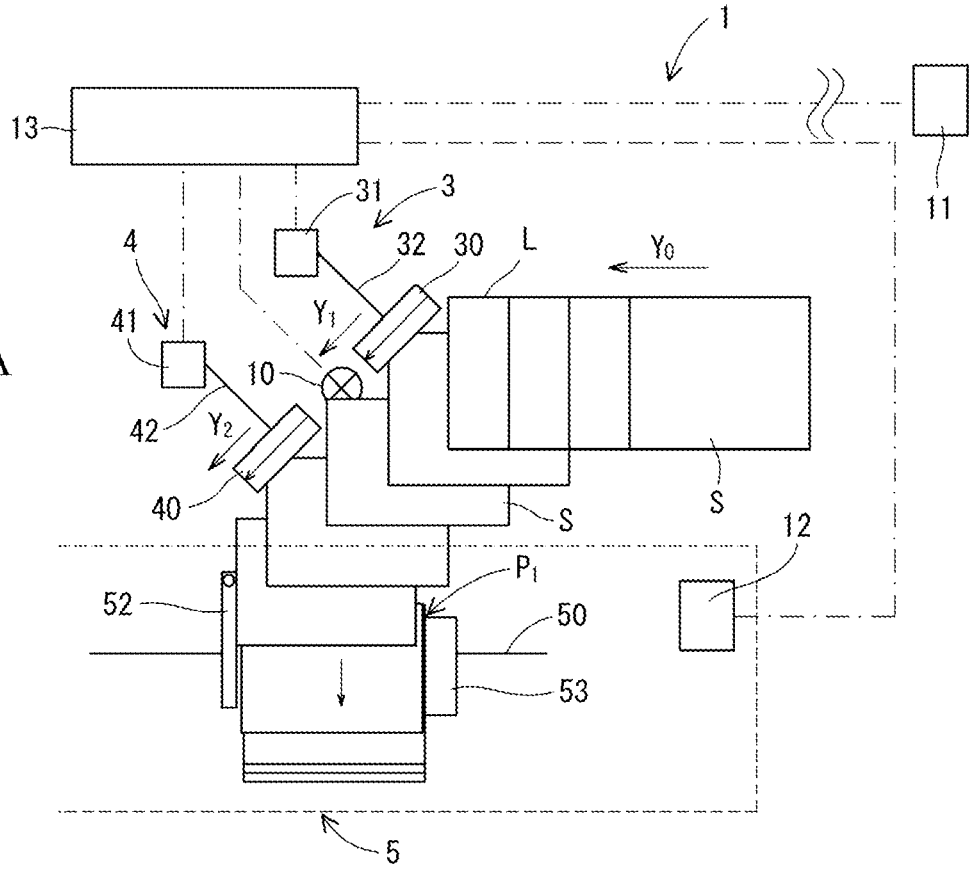
FIG. 5A illustrates stacking sheets.

As illustrated in FIG. 5A, the control part 13 continuously rotates the conveyance roller(s) 40 in order to stack the predetermined number of the sheets S at the stacking position $P_1$. The sheets S are sequentially conveyed by the pair of conveyance rollers 30 to the pair of conveyance rollers 40, and then conveyed by the pair of conveyance rollers 40 to the stacking unit 5. The sheets S come into contact with the stopper 52 which is located at the contact position, and thus drop to the stacking position $P_1$. This causes the sheets S to be stacked at the stacking position $P_1$ on the chain or belt 50 in a straddling manner.

Figure 5B:
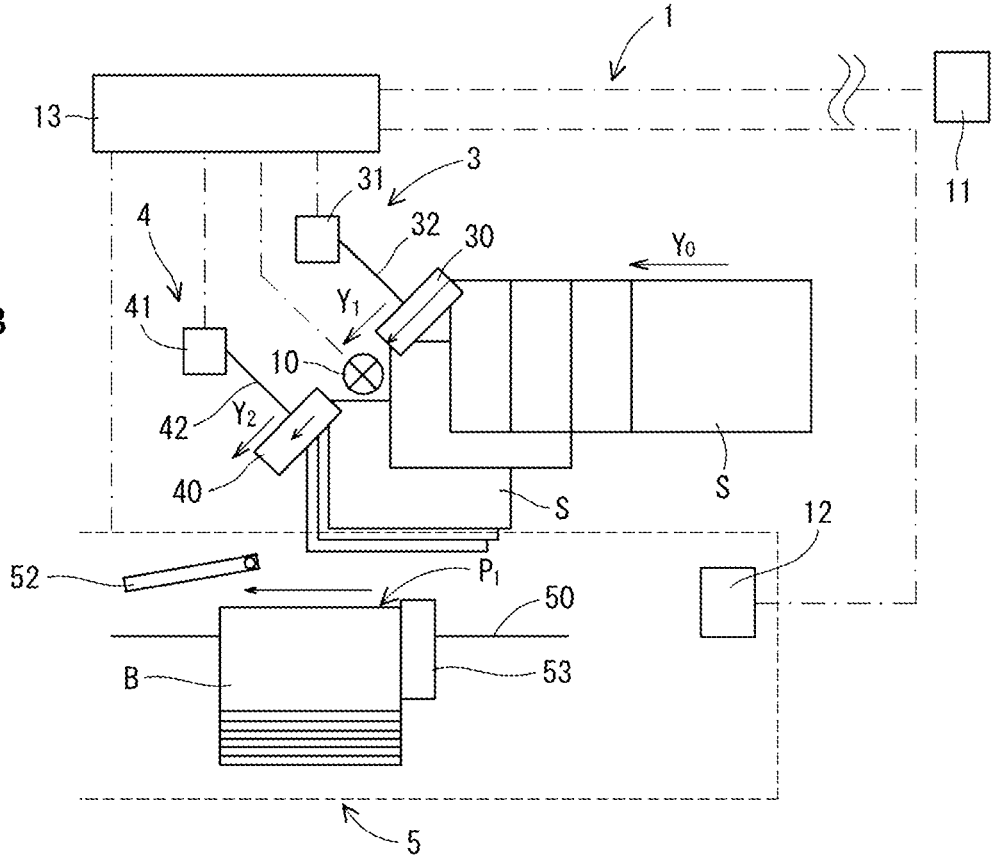
FIG. 5B illustrates conveying a sheet stack.

As illustrated in FIG. 5B, the control part 13, in response to determining that the last sheet S for the sheet stack B has passed through the pair of conveyance rollers 40 to complete the sheet stack B at the stacking position $P_1$, controls the stacking unit 5 to convey the sheet stack B from the stacking position $P_1$. That is, the stacking unit 5 moves the stopper 52 from the contact position to the retraction position and conveys the sheet stack B from the stacking position $P_1$ by means of rotation of the chain or belt 50.

Concurrently, the control part 13, in response to determining that the last sheet S has passed through the pair of conveyance rollers 40, switches the conveyance rollers 40 from continuous rotation to intermittent rotation. Although the oblique conveyance unit 3 (the pair of conveyance rollers 30) continues to sequentially convey the sheets S for the next sheet stack B, the pair of conveyance rollers 40, by means of the intermittent rotation thereof, sequentially sandwiches these sheets S, conveys these sheets S a little but keeps these sheets S sandwiched. Thereby, the pair of conveyance rollers 40 keeps/prevents/stops the sheets S for the next sheet stack B from being conveyed to the stacking unit 5. It is determined using the sensors 10 and 11 as described above that the last sheet S has passed through the pair of conveyance rollers 40.

Alternatively, the control part 13 may, in response to determining that the last sheet S has passed through the pair of conveyance rollers 40, switch the conveyance rollers 40 from continuous rotation to stop. The pair of conveyance rollers 40, by means of stop of rotation thereof, sandwiches at least the first sheet S for the next sheet stack B to hold the at least first sheet S such that subsequent sheets S are placed on the at least first sheet S in sequence. Thereby, the pair of conveyance rollers 40 is also able to keep the sheets S for the next sheet stack B from being conveyed to the stacking unit 5.

As described above, the sheet detection device 1 keeps the sheets S for the next sheet stack S from being conveyed from the stacking position $P_1$ without stopping the oblique conveyance unit 3 from conveying the sheets S, while the stacking unit 5 is conveying the sheet stack B from the stacking position $P_1$. Upon completion of conveying the sheet stack B from the stacking position $P_1$, the stacking unit 5 becomes ready to receive the sheets S for the next sheet stack B at the stacking position $P_1$.

The control part 13, in response to determining that the stacking unit 5 has become ready to receive the sheets S for the next sheet stack B, switches the conveyance rollers 40 from intermittent rotation or stop to continuous rotation. Thereby, the pair of conveyance rollers 40 starts to convey the sheets S to the stacking unit 5. The sheets S for the next sheet stack B which have been kept from being conveyed are conveyed to the stacking position $P_1$ by the pair of conveyance rollers 40. The sheets S subsequent to these are also then conveyed by the pair of conveyance rollers 40 to the stacking position $P_1$. This results in the sheets S for the next sheet stack B being stacked at the stacking position $P_1$. It is determined using the sensor 12 as described above that the stacking unit 5 has become ready to receive the sheets S for the next sheet stack B.

Subsequently, this is repeated, so that the sheet stacks B are conveyed from the stacking position $P_1$ one after another. Each of the sheet stack B is then processed by other devices (not shown) such as a saddle stitching device, a three-side trimmer.

The sheet detection device and method are not limited to the above embodiments. The sheet detection device and method may be used for other purposes than the stacking device 1 or the binding system.

The horizontal conveyance unit 2 of the embodiments is configured to fold the sheets S while conveying the sheets S. Alternatively, the horizontal conveyance unit 2 may place the pre-folded sheets on an endless belt or chain in a straddling manner with the sheets S overlapped with each other, and convey these sheets S horizontally and successively by means of rotation of the belt or chain.

Figure 6:
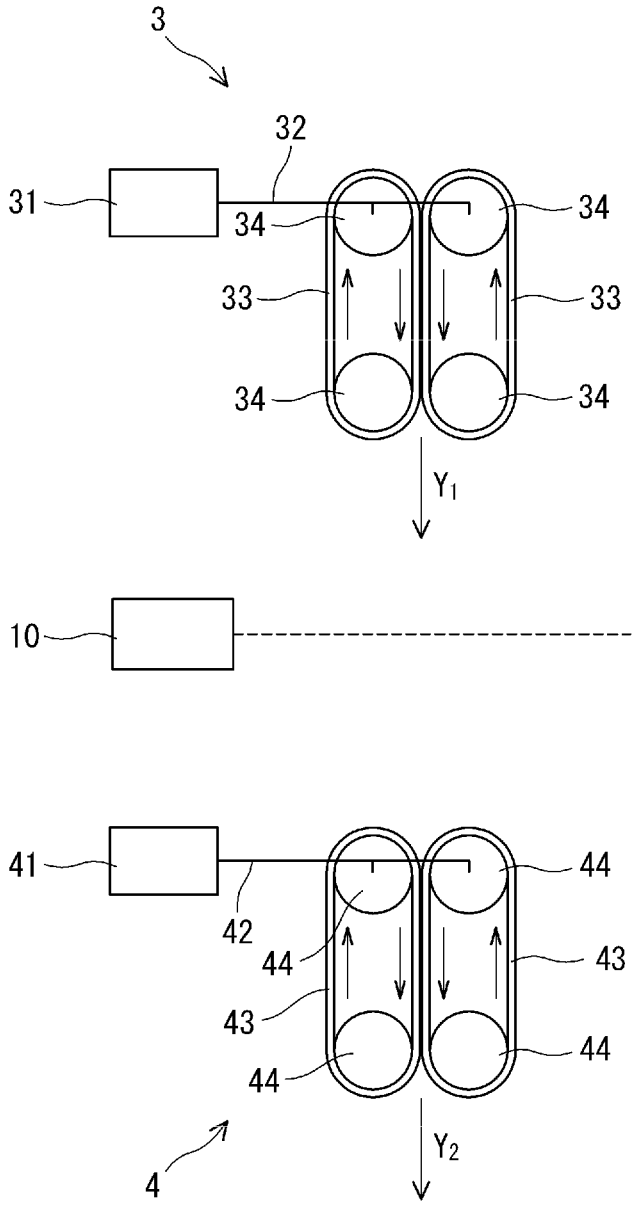
FIG. 6 is a schematic view of another exemplary sheet detection device.

The pair of conveyance rollers 30/40 is used as the pair of conveyance members in the above embodiments. Alternatively, as illustrated in FIG. 6, the pair of conveyance members may be a pair of conveyance belts 33/43 opposing to each other and arranged for receiving and sandwiching the sheets S from the horizontal conveyance unit 2/oblique conveyance unit 3. The endless conveyance belts 33/43 are engaged with pulleys 34/34 which are arranged at intervals in the conveyance direction $Y_1/Y_2$ and each is rotatable about an axis extending perpendicularly to the conveyance direction $Y_1/Y_2$. Thereby, the endless conveyance belts 33/43 extend in the conveyance direction $Y_1/Y_2$. The conveyance belts 33/43 are driven to rotate by the motor 31/41 and the transmission mechanism 32/42. The conveyance unit 3/4 conveys the sheets S in the conveyance direction $Y_1/Y_2$ through the pair of conveyance belts 33/43 while sandwiching the sheets S between the pair of conveyance belts 33/43 by means of rotation of the conveyance belts 33/43.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sheet detection device comprising:

a horizontal conveyance unit configured to convey sheets successively and horizontally, wherein each of the sheets is conveyed by the horizontal conveyance unit, and conveyed out of the horizontal conveyance unit in a state of being folded along a fold line with the fold line oriented upward, the fold line extending in a conveyance direction of the horizontal conveyance unit;

an oblique conveyance unit comprising a pair of first conveyance members arranged for receiving the sheets from the horizontal conveyance unit, the oblique conveyance unit being configured to successively convey the sheets in an oblique downward direction through the pair of first conveyance members while sandwiching both sides of the sheets between the pair of first conveyance members;

a sensor arranged to detect passage of the sheets at a position where steps pass, each of the steps being formed by two sheets adjacent to each other diverted to the oblique downward direction by the oblique conveyance unit;

a downstream conveyance unit including a pair of second conveyance rollers arranged for receiving the sheets conveyed out of the oblique conveyance unit, the downstream conveyance unit being configured to convey the sheets to a stacking position through the pair of second conveyance members while sandwiching both sides of the sheets between the pair of first conveyance members; and a stacking unit configured to receive the sheets from the downstream conveyance unit, to stack a predetermined number of the sheets at the stacking position so as to form a sheet stack, and to convey the sheet stack from the stacking position, wherein each of the sheets is conveyed by the horizontal conveyance unit in a state of being overlapped with a next sheet from above, wherein each of the steps is formed by an upper edge of a sheet of the two sheets and a front edge of a next sheet of the two sheets or a rear edge of a sheet of the two sheets and a lower edge of a next sheet of the two sheets, and wherein the pair of second conveyance rollers is configured to keep the sheets sandwiched so as to prevent the sheets from being conveyed to the stacking unit in a case where it is determined using the sensor that the last sheet of the sheet stack has passed through the pair of second conveyance rollers.

2. The sheet detection device according to claim 1, wherein the pair of first conveyance members is a pair of first conveyance rollers or a pair of first conveyance belts.

3. The sheet detection device according to claim 1, wherein the horizontal conveyance unit is further configured to fold the sheets while conveying the sheets.

4. The sheet detection device according to claim 1, wherein the sensor is an optical sensor.

5. The sheet detection device according to claim 1, further comprising a control part configured to count the number of sheets that pass through a detection area of the sensor based on detection by the sensor.

6. A method for detecting sheets which are being successively conveyed, wherein each of the sheets is conveyed by a horizontal conveyance unit, and conveyed out of the horizontal conveyance unit in a state of being folded along a fold line with the fold line oriented upward, the fold line extending in a conveyance direction of the horizontal conveyance unit, the method comprising:

successively conveying the sheets which have been conveyed out of the horizontal conveyance unit, in an oblique downward direction using a pair of first conveyance members through the pair of first conveyance members while sandwiching both sides of the sheets between the pair of first conveyance members;

detecting passage of the sheets using a sensor at a position where steps pass, each of the steps being formed by two sheets adjacent to each other which have been diverted to the oblique downward direction;

conveying the sheets which have been conveyed out of the pair of first conveyance members to a stacking position, using a pair of second conveyance members through the pair of second conveyance members while sandwiching both sides of the sheets between the pair of second conveyance members;

stacking a predetermined number of the sheets at the stacking position so as to form a sheet stack; and conveying the sheet stack from the stacking position, wherein each of the sheets is conveyed by the horizontal conveyance unit in a state of being overlapped with a next sheet from above, wherein each of the steps is formed by an upper edge of a sheet of the two sheets and a front edge of a next sheet of the two sheets or a rear edge of a sheet of the two sheets and a lower edge of a next sheet of the two sheets, and wherein the pair of second conveyance rollers is configured to keep the sheets sandwiched so as to prevent the sheets from being conveyed to the stacking unit in a case where it is determined using the sensor that the last sheet of the sheet stack has passed through the pair of second conveyance rollers.

7. The method according to claim 6, wherein a pair of conveyance rollers or a pair of conveyance belts is used as the pair of conveyance members.

8. The method according to claim 6, wherein an optical sensor is used as the sensor.

9. The method according to claim 6, further comprising counting the number of sheets that pass through a detection area of the sensor based on detection by the sensor.

* * * * *